US005158261A

United States Patent [19]

Morohoshi

[11] Patent Number: 5,158,261

[45] Date of Patent: Oct. 27, 1992

[54] PROPORTIONAL COMBUSTION CONTROL DEVICE

[75] Inventor: Yukuo Morohoshi, Kanagawa, Japan

[73] Assignee: Yamatake-Honeywell Co., Ltd., Tokyo, Japan

[21] Appl. No.: 774,534

[22] Filed: Oct. 8, 1991

[30] Foreign Application Priority Data

Oct. 26, 1990 [JP] Japan ..... 2-290024

[51] Int. Cl.[5] ..... F16K 31/08

[52] U.S. Cl. ..... 251/65; 431/89; 431/90; 137/625.4

[58] Field of Search ..... 431/89, 90; 137/625.4; 251/65

[56] References Cited

U.S. PATENT DOCUMENTS

| | | | |
|---|---|---|---|
| 3,661,302 | 5/1972 | Braun | 251/65 |
| 4,819,693 | 4/1989 | Rodder | 251/65 X |
| 4,988,074 | 1/1991 | Najmolhoda | 251/65 X |

*Primary Examiner*—Larry Jones
*Attorney, Agent, or Firm*—Whitham & Marhoefer

[57] ABSTRACT

A proportional combustion control device for supplying fuel to a combustor for a boiler, a hot water maker, etc., comprising an opening and closing valve for controlling a supply of fuel provided in the midst of a fuel supply pipe, and a control valve having a spindle whose needle portion at the extreme end is moved in and out of a nozzle and an exciting coil to generate a drive force for intermittently and axially moving said spindle against the restoring force by being supplied with a drive pulse, wherein even if fuel is either oil or gas, proportional control of combustion can be made, and the spindle is intermittently moved in the range capable of continuously carrying out combustion to open and close the nozzle whereby jetting of fuel is subjected to proportional control at the turndown ratio of 1/5 to 1/10 to always render the stabilized combustion possible.

2 Claims, 4 Drawing Sheets

PROPORTIONAL COMBUSTION CONTROL DEVICE

BACKGROUND OF THE INVENTION

1. Field of the Invention

This invention relates to a proportional combustion control device for adjusting a supply of fuel to a combustor for a boiler, a hot water unit, etc. to control combustion.

2. Description of the Prior Art

FIG. 1 is a schematic view showing a conventional combustion control device. In FIG. 1, reference numeral 1 designates a fuel tank, and 2 designates a fuel supply pipe having one end connected to the fuel tank 1, an extreme end of which is provided a nozzle 3 composed of a fixed orifice as shown in FIG. 2. Reference 4 designates a pump for feeding under pressure fuel 5 to the nozzle 3 provided in the midst of the fuel supply pipe 2, and 6 designates an opening and closing valve for controlling a supply of fuel to the pump 4.

The operation of the device will be described hereinbelow. When the valve 6 is opened to actuate the pump 4, fuel 5 in the fuel tank 2 is fed under pressure to the extreme end of the fuel supply pipe 2, and the fuel 5 is jetted in an atomized form out of the nozzle 3.

The conventional proportional combustion control device is configured as described above. In the case where a boiler less than 40000 Kcal and an instantaneous hot water maker for home are used and fuel is oil, fuel supply pressure has to be controlled for proportional combustion control since the nozzle 3 is a fixed orifice. However, when pressure is excessively lowered. particles when oil is jetted become large, flame becomes large, firing becomes hard or soot is produced. As the result, the fuel supply pressure cannot be excessively lowered. The number of opening and closing of the valve 6 per unit time is changed to control the fuel supply. However, the combustion is turned into indirect combustion, posing a problem in that firing noises, "bang", occur at the time of firing.

A conventional combustion control device in which fuel is limited to oil alone is shown in FIG. 3. FIG. 3 shows a boiler control device shown, for example, in Japanese Patent Laid-Open No. 55 (1980)—3600 publication. In FIG. 3, a boiler control device 20 is shown. The boiler control device 20 is provided with an oil burner 22 having a combustion chamber 24. Fuel oil 26 is supplied from a supersonic nozzle 28 to the combustion chamber 24, and a nozzle 28 jets the fuel oil 26 through a hole 30 of a flame holder 32. The oil burner 22 is provided with a heat exchanger 34 as shown.

The supersonic nozzle 28 is a vibration device having a closure element of a ball valve, said element being moved by vibrations of the vibration device from a position at which an oil path is closed to a position at which the oil path is opened.

When the supersonic nozzle 28 electronically controls a ratio of off time to on time, the boiler control device 20 acts so that it is switched to on and off with high frequency.

Reference numeral 44 designates a thermostat for detecting a temperature of liquid to be heated. Information of the thermostate 44 is transmitted to a control device 42 through a conductor 46. The control device 42 controls a speed of a ian 52 and controls a quantity of fuel oil to the supersonic nozzle 28 through a fuel oil supply pipe 60.

More specifically, this boiler control device comprises an oil burner, an electrically operated oil jetting device provided with vibration means having a ball valve closure element which is moved by vibration from a position at which an oil path is closed to a position at which the oil path is opened in order to supply a suitable quantity of oil to a combustion chamber of said oil burner, and a switch device for controlling on and off time of said oil jetting device, whereby combustion is controlled in a simple method without using a complicated expensive burner nozzle. However, in the conventional device, fuel is limited to oil alone as mentioned above, and in case of gas, there is a drawback that it cannot be applied.

Next, in the case where gas is used as fuel, there is no inconvenience encountered in case of oil as described above and no measure thereto is necessary. However, a turndown ratio of 1/5 to 1/10 is necessary in order to improve the fuel supply control. If this is effected by a governor, fuel supply pressure should be set to 1/25 and 1/100 at the turndown ratio of 1/5 and 1/10, respectively. Accordingly, even if the fuel supply pressure is 100 $mmH_2O$, the pressure is 1/100, and actually, it should be changed to 1 $mmH_2O$. Therefore, it is impossible to control 1:10 by a single pressure-feed means. In view of this, it is contemplated that two pressure-feed means are used, and the range of the pressure-feed means is divided for use.

SUMMARY OF THE INVENTION

An object of this invention is to provide a proportional combustion control device in which in the case where fuel is either oil or gas, proportional combustion thereof is made possible, and in the case where fuel is either oil or gas, the turndown ratio of 1/5 to 1/10 is made possible.

It is a further object of this invention to provide a proportional combustion control device which renders possible proportional combustion of fuel by simple and inexpensive means without using a complicated expensive device.

For achieving the aforesaid objects, a proportional combustion control device according to this invention comprises a fuel supply pipe having a nozzle at the extreme end thereof, an opening and closing valve provided in the midst of said fuel supply pipe to control a supply of fuel to said nozzle, and a control valve having a spindle whose needle portion at the foreend is moved in and out of said nozzle and an exciting coil to generate a drive force for intermittently and axially moving said spindle against the restoring force in the range capable of continuously carrying out combustion to proportionally control jetting of fuel from said nozzle.

The above and other objects and novel features of this invention will become more completely obvious by reading the ensuing detailed description in connection with the accompanying drawings. It is to be noted that the drawings are provided exclusively for interpretation and are not intended to limit the scope of this invention.

DETAILED DESCRIPTION OF THE PREFERRED EMBODIMENTS

Preferred embodiments of this invention wil be described in detail while referring to the accompanying drawings.

Figure 1:
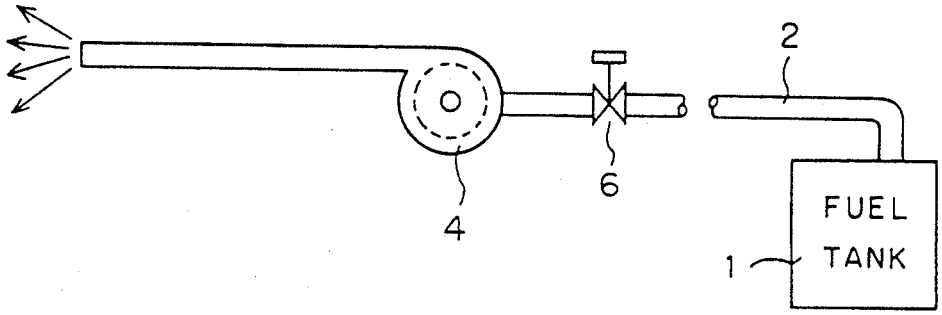
FIG. 1 (PRIOR ART)
FIG. 1 is a schematic view of a conventional combustion control device.
Figure 2:
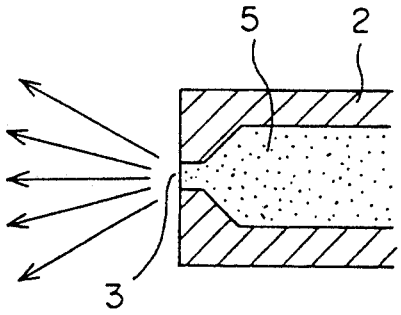
FIG. 2 (PRIOR ART)
FIG. 2 is an enlarged longitudinal sectional view of an extreme end portion of a fuel supply pipe of the conventional device.
Figure 3:
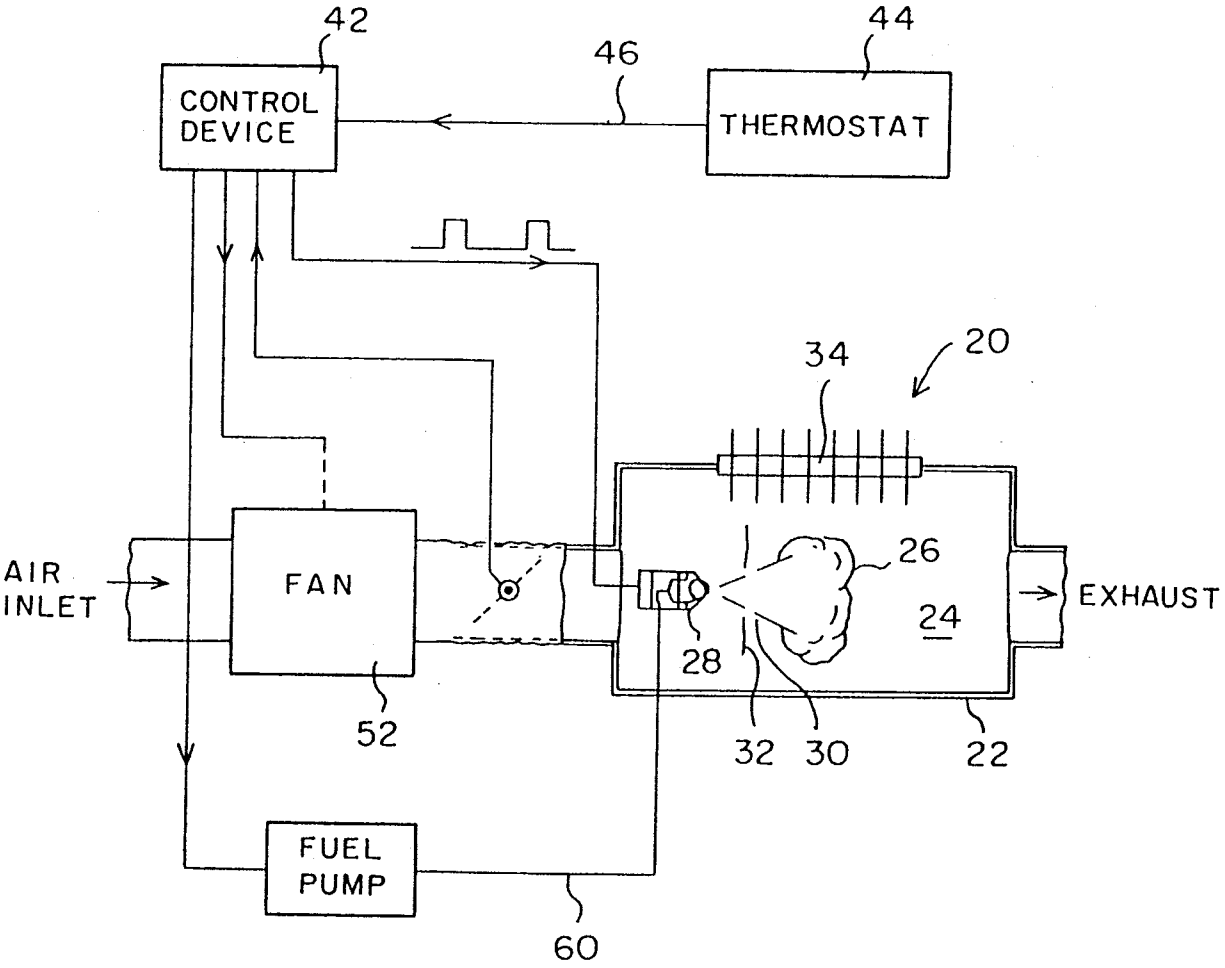
FIG. 3 (PRIOR ART)
FIG. 3 is a schematic view of a conventional boiler control device.
Figure 4:
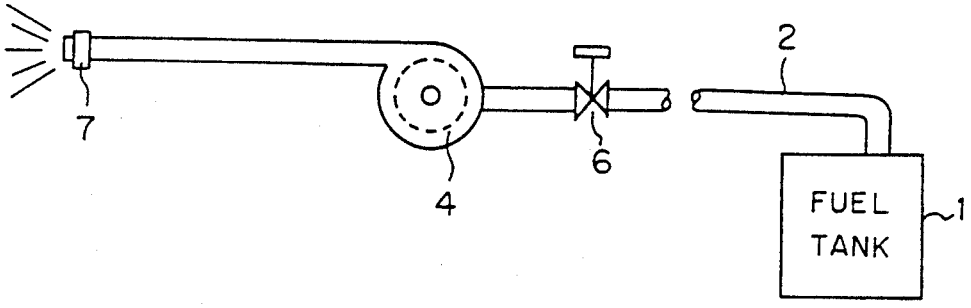
FIG. 4 is a schematic view showing a proportional combustion control device according to an embodiment of this invention.

FIG. 4 is a schematic view showing a proportional combustion control device according to one embodiment of this invention. In FIG. 4, the same reference numerals as those used in FIG. 1 previously mentioned indicate the same parts, and description thereof will be omitted. Reference numeral 7 designates a control valve for proportionally controlling jetting of fuel from a nozzle.

Figure 5:
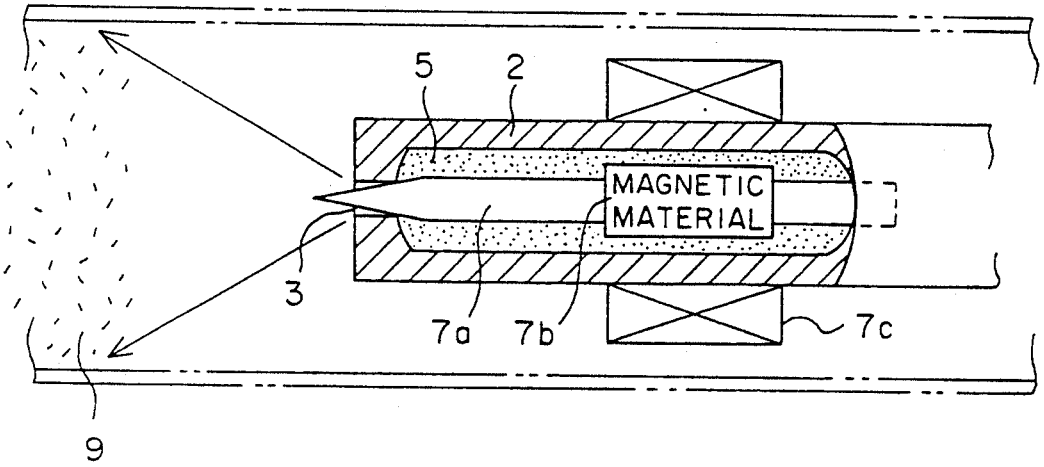
FIG. 5 is an enlarged longitudinal sectional view of an extreme end portion of a fuel supply pipe.

As shown in FIG. 5, this control valve 7 is composed of a spindle 7*a* in which a needle portion at the extreme end thereof is moved in and out of the nozzle 3, a magnetic material 7*b* provided in the midst of the spindle 7*a*, and an exciting coil 7*c* to generate a drive force for moving said spindle 7*a* axially against the restoring force.

The operation of the above-described embodiment will be described hereinafter. When the opening and closing valve 6 is opened to actuate the pump 4, fuel 5 in the fuel tank 2 is fed under pressure to the extreme end of the fuel supply pipe 2.

When under this state, a drive pulse is supplied from a pulse generator not shown to the exciting coil 7*c*, the spindle 7*a* is axially reciprocated by the action of a return spring not shown to open and close the nozzle 3 so that the fuel 5 is intermittently jetted.

The jetted fuel 5 is mixed with air within a combustion zone 9 frontwardly of the nozzle. As the result, even if jetting of the fuel 5 is intermittently carried out, the actual combustion is continuous.

Figure 6:
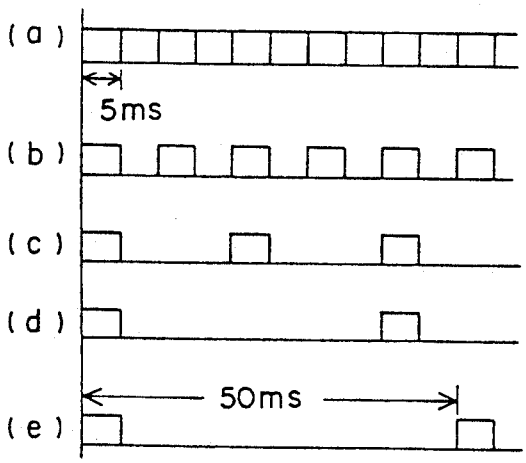
FIG. 6 shows waveforms of a drive pulse with frequency changed.

Now, the open time of the valve 6 is fixed to 5 ms, and the frequency of the drive pulse is changed within the range of 20 to 200 Hz as shown in FIGS. 6 (*a*) to 6 (*e*). Then, the turndown ratio can be continuously changed from 1 to 1/10.

Figure 7:
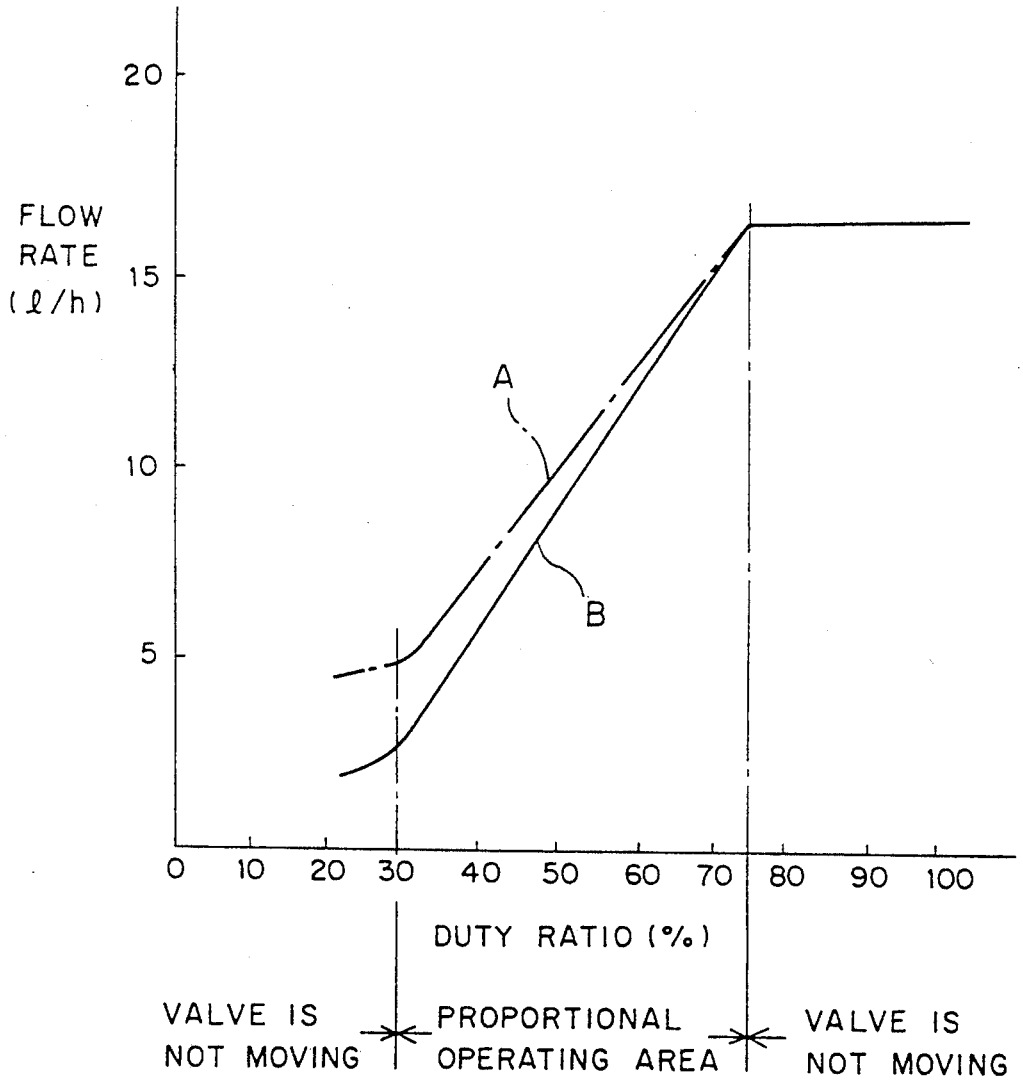
FIG. 7 is a characteristic view of flow rate with respect to a duty ratio in the case where frequency is constant.

Even if, unlike the above, the frequency is fixed, for example, to 50 Hz or 66.7 Hz, and the duty is changed, theoretically, the jetting of fuel can be controlled from 0 to 100%. However, since the valve is actually moved, 2 to 3 ms is necessary. Therefore, the jetting of fuel cannnot be controlled for the aforementioned range of time as shown in FIG. 7. Accordingly, the nozzle opening and closing period caused by the change of frequency or duty and the open time of the valve 6 may be simultaneously changed according to the characteristics of the valve. In FIG. 7, the characteristics A and B indicate cases where frequencies are 50 Hz and 66.7 Hz, respectively.

The nozzle opening and closing period and the valve open time are proportional to the combustion amount required. However, the speed of the combustion fan is determined by a signal for defining the nozzle opening and closing period or the valve open time to provide the speed proportional to the nozzle opening and closing period or the valve open time. Alternatively, the nozzle opening and closing period or the valve open time may be decided by measuring the amount of air or velocity of air of the combustion fan, and making it proportionate.

While in the above-described embodiment, oil is used as fuel, and the fuel feed pump 4 is provided in the midst of the fuel supply pipe 2, it is to be noted that when fuel is gas, this pump 4 is not required.

As described above, according to this invention, there is provided a control valve for proportionally controlling the jetting of fuel from the nozzle provided at the extreme end of the fuel supply pipe. Therefore, it is possible to maintain jetting pressure of fuel high. Even in the case where fuel is oil, atomized particles will not be changed by the flow rate. The stabilized combustion can be attained irrespective of the kind of fuel, oil or gas.

Furthermore, according to this invention, the spindle is intermittently moved in the range capable of carrying out combustion continuously to open and close the nozzle. Therefore, even if fuel is oil or gas, the fuel jetting can be proportionally controlled at the turndown ratio of 1/5 to 1/10. There is an effect such that the stabilized proportional combustion is provided.

What is claimed is:

1. A proportional control valve for a fluid fuel combustion system, comprising in combination:

an injection nozzle adapted to be connected at one end of a fuel supply pipe, said nozzle having an orifice for spraying fuel into a combustion chamber;

a control spindle for proportionally controlling the rate of fuel flow emitted from said orifice, said control spindle including a magnetic section axially aligned with said orifice, said spindle having a tapered end extending into and blocking said orifice in one position of said spindle;

a coil disposed adjacent said spindle so that, when energized, a magnetic field produced by said coil attracts the magnetic section of said spindle causing said spindle to retract from said one position, providing an orifice opening that increases in size in proportion to the movement of said spindle from said one position;

means for energizing said coil with a series of energizing pulses of constant duration; and means coupled to said energizing means to vary the repetition frequency of said energizing pulses.

2. A proportional control valve for a fluid fuel combustion system, comprising in combination:

an injection nozzle adapted to be connected at one end of a fuel supply pipe, said nozzle having an orifice for spraying fuel into a combustion chamber;

a control spindle for proportionally controlling the rate of fuel flow emitted from said orifice, said control spindle including a magnetic section axially aligned with said orifice, said spindle having a tapered end extending into and blocking said orifice in one position of said spindle;

a coil disposed adjacent said spindle so that, when energized, a magnetic field produced by said coil attracts the magnetic section of said spindle causing said spindle to retract from said one position, providing an orifice opening that increases in size in proportion to the movement of said spindle from said one position;

means for energizing said coil with a series of energizing pulses whose duty cycle is variable; and means coupled to said energizing means to vary the duty cycle of said energizing pulses.

* * * * *